US005337804A

United States Patent [19]

Berger et al.

[11] Patent Number: 5,337,804

[45] Date of Patent: Aug. 16, 1994

[54] ADJUSTABLE MOLD POSITIONER

[75] Inventors: Robert P. Berger, Encino; Steven Benson, Simi Valley, both of Calif.

[73] Assignee: Belle De St. Claire, Chatsworth, Calif.

[21] Appl. No.: 59,047

[22] Filed: May 6, 1993

[51] Int. Cl.[5] ..... B22C 9/04; B22D 13/06; B22D 13/10

[52] U.S. Cl. ..... 164/287; 164/289; 269/280; 269/287

[58] Field of Search ..... 164/287, 289, 290, 292, 164/114, 412, DIG. 3, DIG. 4; 433/34; 249/54, 62; 269/287, 279, 280, 283

[56] References Cited

U.S. PATENT DOCUMENTS

| | | | |
|---|---|---|---|
| 1,280,289 | 10/1918 | Perry | 164/287 |
| 1,976,654 | 10/1934 | Carpenter | 164/287 |
| 3,648,762 | 3/1972 | Hill | 164/289 |

OTHER PUBLICATIONS

Trends & Techniques, vol. 8, No. 3; "The Effects of Shape and Size on Investment Heating and Cooling Rates", Berger et al. Apr. 1991.

Belle de St. Claire Universal Oval Ring Positioner product, Feb. 1989.

*Primary Examiner*—J. Reed Batten, Jr.

*Attorney, Agent, or Firm*—Notaro & Michalos

[57] ABSTRACT

An adjustable investment mold positioner includes a resilient band bent into a partial cylinder. Opposite ends of the band bound an opening at the side of the cylinder. A mold receiving member made of bent metal has side walls with bent connectors that are attached to the opposite ends of the band. A recess is formed between the side walls for receiving an oval investment mold. The outer cylindrical configuration of the positioner is readily engageable within the cradle of a conventional casting machine which is designed for normally receiving cylindrical investment molds. In this way, oval investment molds can be received in a secure manner within the conventional casting machines.

14 Claims, 4 Drawing Sheets

ADJUSTABLE MOLD POSITIONER

FIELD AND BACKGROUND OF THE INVENTION

The present invention relates in general to dental and jewelry casting equipment, and in particular to a new and useful positioner designed to position oval or other non-cylindrical investment molds into a casting machine designed to receive cylindrical investment molds only.

A wide variety of casting machines used in the jewelry and dental industry, include cradles for receiving cylindrical investment molds. Investment molds are formed of refractory material containing a mold recess shaped by a lost wax process, for casting metal jewelry and dental parts.

In about 1971, the assignee of the present application introduced oval-shaped casting rings which were used to form oval investment molds. These molds have superior cooling properties while using approximately 40% less investment material than conventional cylindrical molds.

Since dental bridges are generally straight in the posterior (back) of the mouth, dental restorations casted in round rings transverse various zones of expansion. Round rings expand more in the center than they do toward the sides of the ring. Round rings heat at a slower rate in the center than on the outer edges and they cool at a slower rate. The dynamics and advantages of using non-cylindrical, and in particular, oval rings is fully disclosed in an article authored by the co-inventors, "The Effects of Shape and Size on Investment Heating and Cooling Rates", Berger and Benson, *J. of the Nat. Assoc. of Dental Laboratories*, Volume 8, No. 3.

The dental industry has recognized the advantages of the oval-shaped rings but has had difficulty in the past adapting the unusually shaped molds to conventional casting machines. All casting machines manufactured world-wide are designed for various sizes of cylindrical rings. These rings vary from 2.75 to 3.25 inches in diameter. The various casting machines use supportive cradles for positioning these large cylindrical or round rings. Since the oval shape is so different from the round, a supporting ring positioner for the oval-shaped mold is either custom fit for each casting machine or else the oval mold is simply placed in the casting machine cradle in an unsecure position. This often results in unsuccessful casting operations. Examples of commonly used casting machines are the Kerr Centrifico Casting Machine, manufactured by the Kerr Company, Division of Syboron of Romulus, Michigan and the MODULAR 3 Casting Machine manufactured by Nobilium Company of Albany, N.Y.

An object of the present invention is to avoid the problems of securing a non-cylindrical mold in a casting machine designed for cylindrical molds only.

SUMMARY OF THE INVENTION

The main object of the present invention is to provide an adjustable investment mold positioner for positioning a non-cylindrical investment mold having a center button for receiving molten metal, in a casting machine adapted to receive a cylindrical investment mold, the casting machine including a casting crucible having a discharge center for discharging molten metal into the center button of the investment mold in the casting machine. The positioner of the invention comprises: a resilient band having opposite first and second ends, and bent into a partial cylinder having an opening bounded by the opposite ends; and a non-cylindrical mold receiving member having a recess adapted to receive a non-cylindrical investment mold, the mold receiving member being connected to the first and second ends of the resilient band with the recess communicating with the opening in the cylinder, the mold receiving member being attached to the resilient band such that the center button of a non-cylindrical mold received in the recess is aligned with the discharge center of the casting crucible when the resilient band is in the casting machine.

A further object of the present invention is to provide the positioner with adjustment means attached between at least one end of the resilient band and the mold receiving member for adjusting a diameter of the cylinder to change the position of the center button in the resilient band and thus align the center button with discharge center of the casting crucible.

A still further object of the present invention is to provide a positioner for a casting machine which is simple in design, rugged in construction and economical to manufacture, and which can receive non-cylindrical and in particular, oval investment molds which are either of the ringed or ringless type, in conventional casting machines used in the dental and jewelry industries.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
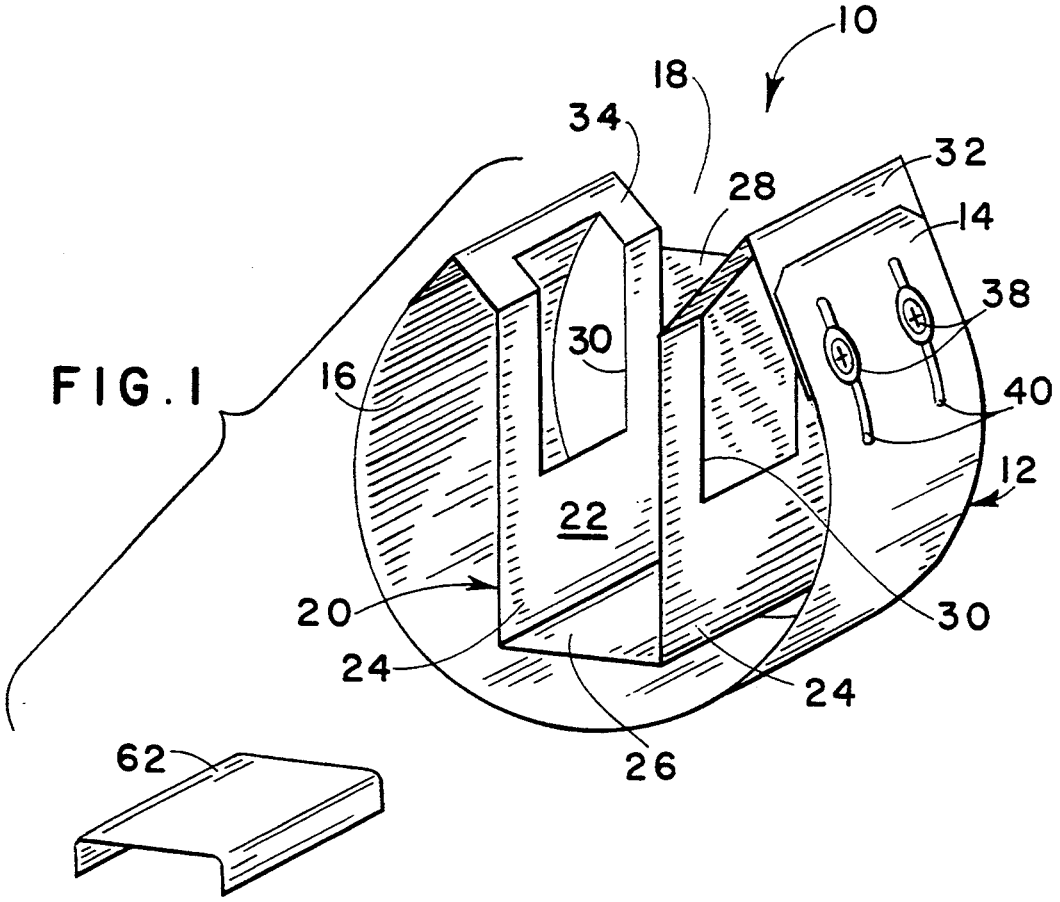
FIG. 1 is an exploded perspective view of the investment mold positioner of the present invention, with small oval investment mold adapter.

Referring to the drawings in particular, the invention embodied in FIG. 1 comprises an adjustable investment mold positioner generally designated 10 for positioning non-cylindrical, in particular oval investment molds in conventional casting machines that are adapted for normally receiving cylindrical investment molds only.

Positioner 10 comprises a resilient band 12 advantageously made of stainless spring steel material, which is bent into a partial cylinder having opposite first and second ends 14 and 16 respectively, which bound an opening 18 in the partial cylinder. A non-cylinder mold receiving member 20 is connected to and between first and second band ends 14, 16. Member 20 is made of stainless steel sheet material in one piece, which is bent into shape and defines a mold receiving recess 22 that communicates at the front of cylinder 12 and also laterally at the side of cylinder 12, specifically at opening 18.

Figure 4:
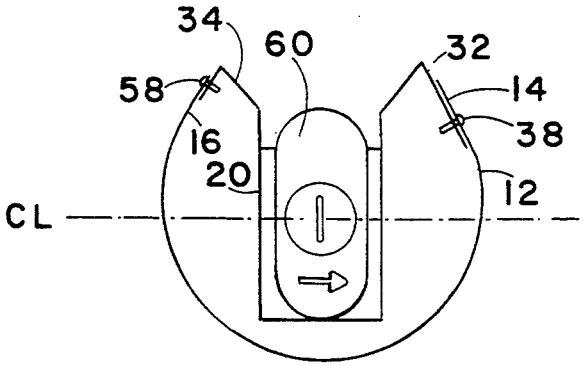
FIG. 4 is a front elevational view of the positioner with a non-cylindrical investment mold therein.
Figure 5:
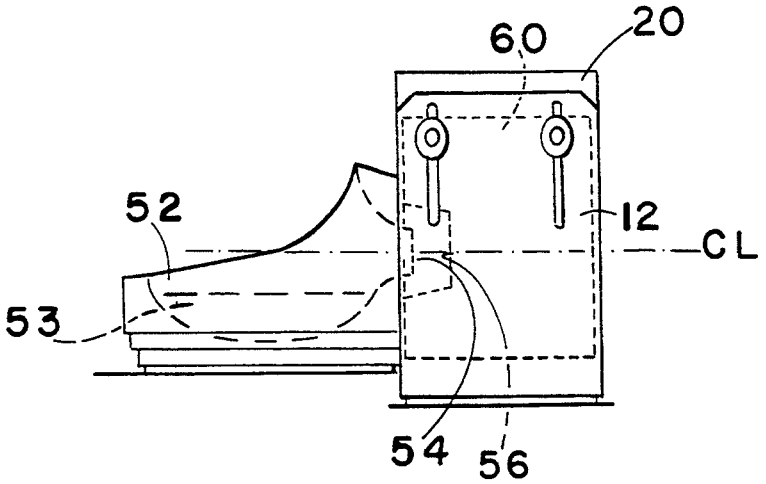
FIG. 5 is a side-elevational view of the positioner containing an investment mold and in association with the casting crucible of a casting machine.

Recess 22, in the embodiment shown, is shaped to receive an oval investment mold shown at 60 in FIGS. 4 and 5 which may be of the ringless type, that is investment material alone, or of the ringed type, that is investment material set inside an oval metal shell.

Returning to FIG. 1, mold receiving member 20 includes a pair of spaced side walls 24, on opposite sides of recess 22, a floor 26 and a back wall 28. Side walls 24 each include a side opening 30 and upper edges to which bent connectors 32 and 34 extend.

Bent connector 32 is connected by adjustment means to the first end 14 of resilient band 12, while bent connector 34 is fixed to the opposite second end 16.

Figure 7:
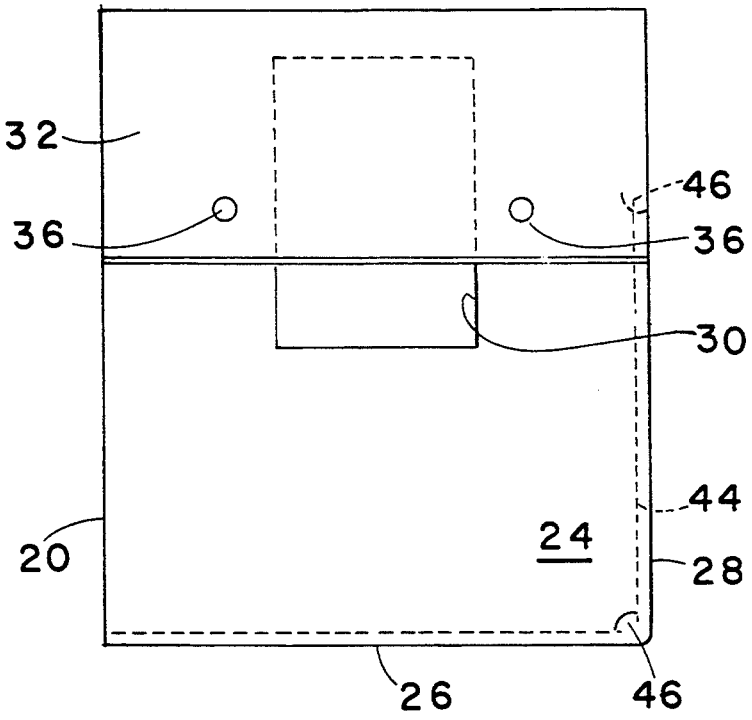
FIG. 7 is a side-elevational view of the mold receiving member.

As best shown in FIG. 7, bent connector 32 includes a pair of threaded holes 36 for receiving screws 38 shown in FIG. 1. Screws 38 include washers and extend through a pair of elongated slots 40 extending circumferentially in end 14. By loosening screws 38 and sliding end 14 along bent connector 32, the diameter of cylinder 12 can be increased or decreased. Since sections of connectors 32 and 34 which are connected to band 12, extend substantially tangentially to the band, the change in diameter in band or cylinder 12, maintains a center position for member 20 in the cylinder. Slots 40 are long enough to adjust the cylinder diameter between 2.75 and 3.25 inches.

Connector 34 is fixed to second end 16 of band 12, by screws 58 threaded into holes 42 which are aligned with holes in the end 16.

An alternate embodiment of the invention utilizes adjustment means at both ends of the band 12.

Figure 6:
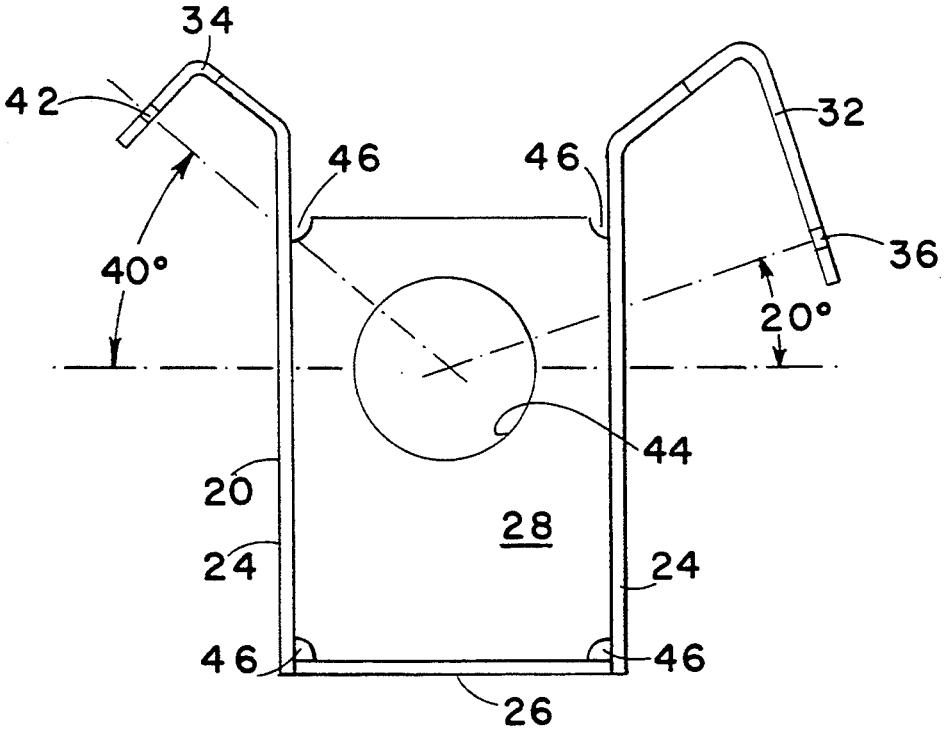
FIG. 6 is a front-elevational view of a mold receiving member of the positioner.

It is preferred that the adjustment means be provided only at one end of the band, however, so that only one end connector 32 is elongated for accommodating the change in diameter (see FIG. 6). Side openings 30 as well as a circular rear opening 44 in the back wall 28, reduce the weight of member 20 and also provide freer access to the investment mold in recess 22.

Notches 46 are also provided at critical junctions between the sides, back and floor of member 20 so that it can be readily bent from a single sheet of stainless steel material into the mold receiving member without the danger of fractures or metal fatigue in the bend areas. Notches 46 are all in the junctions between the back wall 28 and the side walls 24 or with the floor 26.

Advantageously, holes 36 in connector 32 are at approximately 20° from the horizontal as shown in FIG. 6 while holes 32 in connector 34 are at about 40°.

Figure 2:
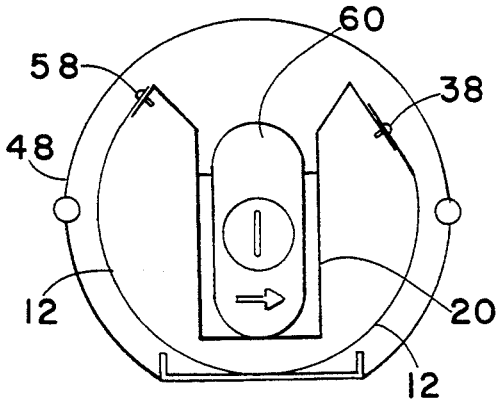
FIG. 2 is a front elevational view of the positioner of the present invention in the cradle of a conventional casting machine.
Figure 3:
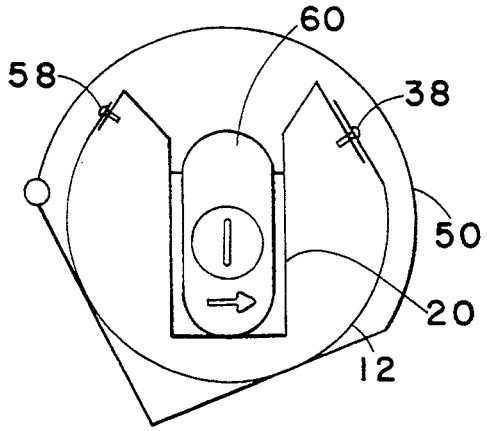
FIG. 3 is a view similar to FIG. 2 showing the positioner of the invention in the cradle of another conventional casting machine.

FIG. 2 shows a cradle 48 comprising straps for normally receiving a cylindrical investment mold. As shown in FIG. 2, cylinder 12 mimics the outer cylindrical configuration of a cylindrical mold yet receives the non-cylindrical investment mold 60 which can be loaded into the top opening 18 of cylinder 12 and into member 20. Another cradle construction is shown at 50 in FIG. 3.

As shown in FIG. 5, the crucible 52 of a conventional casting machine, containing molten metal 53 to be injected through a center discharge 54, is positioned next to the center button or receiving hole 56 of the investment mold 60. By adjusting the diameter of cylinder 12 to a larger diameter, the mold receiving member 20 and thus the center button 56, rises as the outer surface of cylinder 12 pushes the entire cylinder upwardly against the casting machine cradle. Conversely, to lower the center button 56 with respect to the center discharge 54, the diameter of cylinder 12 is reduced. This is achieved through slots 40 and screws 38. As noted above, the opposite end 16 of band or cylinder 12, is fixed, for example by screws 58, to the bent connector 34.

For oval investment molds which are of smaller size than molds 60, a U-shaped insert 62 which is also made of bent stainless steel sheet material, can be slit over floor 26 and between side walls 24 to lift the center button of the smaller oval in the mold receiving member 20 (see FIG. 1).

Figure 8:
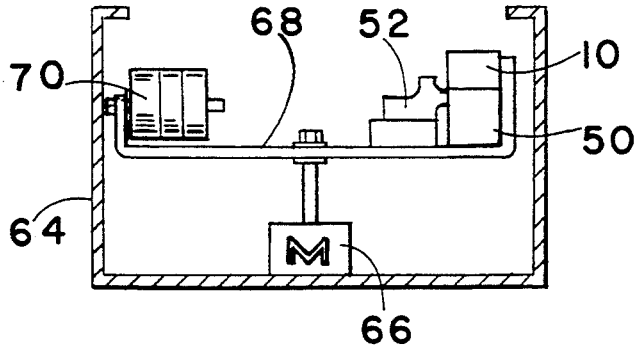
FIG. 8 is a side-schematic view, partially in section of major components in a conventional casting machine.

Referring to FIG. 8, conventional casting machines generally comprise a safety enclosure 64, of cylindrical configuration, containing a motor 66 having a shaft to which an arm 68 is fixed.

The cradle 50 containing positioner 10 and associated with crucible 52, is mounted at one end of arm 68, and an adjustable counterweight 70 is mounted on the opposite end of the arm.

When motor 66 is started, arm 68 rotates and molten metal, e.g. precious metal, in crucible 52 moves by centrifugal force into the investment mold contained within positioner 10, held in cradle 50.

While a specific embodiment of the invention has been shown and described in detail to illustrate the application of the principles of the invention, it will be understood that the invention may be embodied otherwise without departing from such principles.

What is claimed is:

1. An investment mold positioner for positioning a non-cylindrical investment mold having a center button for receiving molten metal, in a casting machine adapted to receive a cylindrical investment mold, the casting machine including a casting crucible having a discharge center for discharging molten metal into the center button of an investment mold in the casting machine, the positioner comprising:

a resilient band having opposite first and second ends, and bet into a partial cylinder having an opening bounded by the opposite ends;

a non-cylindrical mold receiving member having a recess adapted to receive a non-cylindrical investment mold, the mold receiving member being connected to the first and second ends of the resilient band with the recess communicating with the opening in the partial cylinder, the mold receiving member being attached to the resilient band such that the center button of a non-cylindrical mold received in the recess is aligned with the discharge center of the casting crucible when the resilient band is in the casting machine and adjustment means connected between at least one of the first and second ends of the band, and the mold receiving member, for adjusting a diameter of the partial cylinder and thus a relative position between the center button of a mold in the mold receiving member and the center discharge of a casting machine containing the partial cylinder.

2. A positioner according to claim 1, wherein the adjustment means comprises at least one elongated slot extending circumferentially in the first end, and a fastener extending through the slot for releasably attaching the first end of the band to the mold receiving member.

3. A positioner according to claim 1, wherein the mold receiving member includes a back wall, a pair of side walls connected to the back wall, each side wall being connected to one of the first and second ends, and a floor connected to the back wall and extending between the side walls, the recess being defined between the side walls.

4. A positioner according to claim 3, wherein each side wall includes an upper edge spaced from the floor, the mold receiving member including a bent connector connected between each side wall and one of the first and second ends.

5. A positioner according to claim 4, wherein each bent connector includes a portion extending substantially tangentially to the partial cylinder.

6. A positioner according to claim 5, wherein the adjustment means is connected between at least one of the first and second ends, and one of the bent connectors.

7. A positioner according to claim 6, wherein the adjustment means includes at least one circumferential slot in the first end of the band, and a fastener extending through the slot for connecting the first end of the band to the bent connector of the mold receiving member.

8. A positioner according to claim 7, wherein the mold receiving member is made of a single bent piece of sheet metal.

9. A positioner according to claim 8, wherein the band is made of a strip of spring metal.

10. A positioner according to claim 9, including a U-shaped insert for insertion on the floor of the member and between the side walls, for accommodating smaller investment molds.

11. An adjustable investment mold positioner for positioning oval investment molds in a casting machine adapted to receive cylindrical investment molds, comprising:

a resilient metal band having opposite ends and bent into a partially cylindrical shape with an opening bounded by the ends;

a mold receiving member having a recess for receiving an oval investment mold, the member having opposite side walls on opposite sides of the recess and a floor, each side wall having an edge opposite the floor, and bent connectors connected between each edge of the member and one of the ends of the band for attaching the member to the band; and adjustment means connected between at least one end of the band and one bent connector of the member for adjusting a diameter of the partially cylindrical shape.

12. A positioner according to claim 11, wherein the mold receiving member is made of a single piece of sheet metal, bent to form the side walls, bent connectors and floor of the member.

13. A positioner according to claim 12, wherein each bent connector has a portion extending tangentially to the band in its partial cylindrical shape.

14. A positioner according to claim 13, wherein said adjustment means includes at least one slot in one of the bent connectors and one end of the band, and a fastener for extending through the slot and for removably attaching the one end of the band to the bent connector.

* * * * *